US008844166B2

(12) United States Patent
Jazdanian

(10) Patent No.: US 8,844,166 B2
(45) Date of Patent: Sep. 30, 2014

(54) INSOLE HAVING A VIBRATING DEVICE

(75) Inventor: Jean-François Jazdanian, Us (FR)

(73) Assignee: Quo Vadis, Sevres (FR)

( * ) Notice: Subject to any disclaimer, the term of this patent is extended or adjusted under 35 U.S.C. 154(b) by 710 days.

(21) Appl. No.: 13/143,641

(22) PCT Filed: Jan. 8, 2010

(86) PCT No.: PCT/EP2010/050135

§ 371 (c)(1),
(2), (4) Date: Jul. 7, 2011

(87) PCT Pub. No.: WO2010/079207

PCT Pub. Date: Jul. 15, 2010

(65) Prior Publication Data

US 2011/0271554 A1 Nov. 10, 2011

(30) Foreign Application Priority Data

Jan. 9, 2009 (FR) ..... 09 50113

(51) Int. Cl.

| | |
|---|---|
| ***A43B 13/38*** | (2006.01) |
| ***A43B 7/00*** | (2006.01) |
| ***A43B 3/00*** | (2006.01) |
| ***A43B 7/14*** | (2006.01) |
| ***A43B 17/00*** | (2006.01) |

(52) U.S. Cl.

CPC ..... *A43B 7/00* (2013.01); *A43B 3/0005* (2013.01); *A43B 7/146* (2013.01); *A43B 17/00* (2013.01)

USPC ..... 36/43; 36/141

(58) Field of Classification Search

USPC ..... 36/43, 44, 141, 25 R

See application file for complete search history.

(56) References Cited

U.S. PATENT DOCUMENTS

| | | | | |
|---|---|---|---|---|
| 5,592,759 | A | 1/1997 | Cox | |
| 5,913,838 | A | 6/1999 | Reilly | |
| 7,347,831 | B2 * | 3/2008 | Chiu | 601/15 |
| 7,832,124 | B2 | 11/2010 | Blockton | |
| 2005/0049653 | A1 * | 3/2005 | Wang | 607/48 |
| 2011/0232134 | A1 * | 9/2011 | Radl et al. | 36/141 |
| 2012/0030970 | A1 * | 2/2012 | Kim | 36/25 R |
| 2012/0186101 | A1 * | 7/2012 | Sanchez | 36/44 |

FOREIGN PATENT DOCUMENTS

| | | |
|---|---|---|
| EP | 1 608 303 | 12/2005 |
| EP | 1 637 049 | 3/2006 |
| EP | 1 709 880 | 10/2006 |
| JP | 8089482 | 4/1996 |
| JP | 2005052273 | 3/2005 |
| WO | WO 2006/130591 | 12/2006 |
| WO | WO 2007043724 A1 * | 4/2007 |

OTHER PUBLICATIONS

International Search Report and Written Opinion dated May 26, 2010 for Application No. PCT/EP2010/050135.

* cited by examiner

*Primary Examiner* — Ted Kavanaugh
(74) *Attorney, Agent, or Firm* — Frost Brown Todd LLC

(57) ABSTRACT

Insole (1) intended to be placed removably in a shoe (8), said insole comprising a long and thin body (2) and a vibrating device (4) embedded in said body (2), said vibrating device (4) comprising an electric accumulator (12), a control system (14) and a vibration generator (16).

15 Claims, 2 Drawing Sheets

FIG.3.
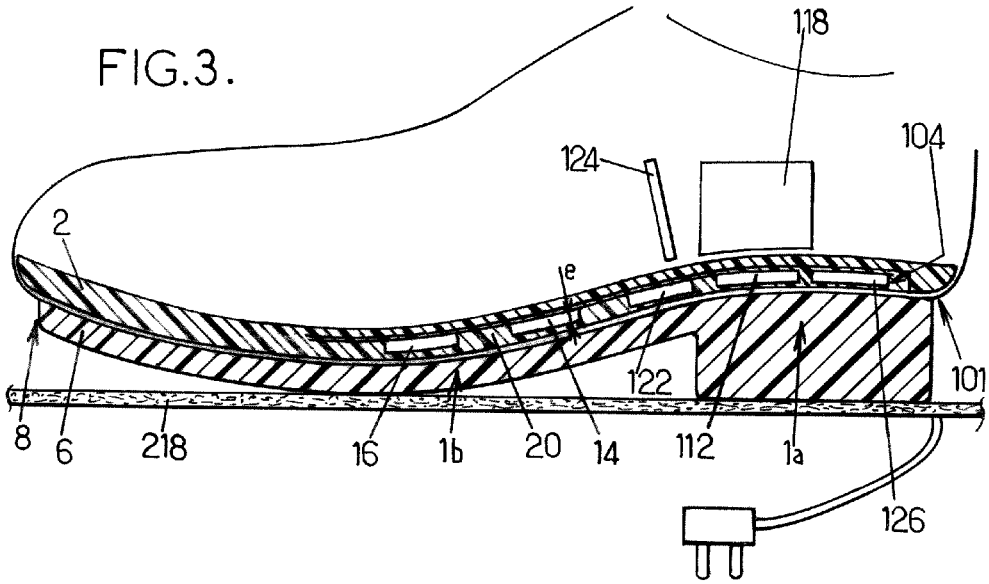
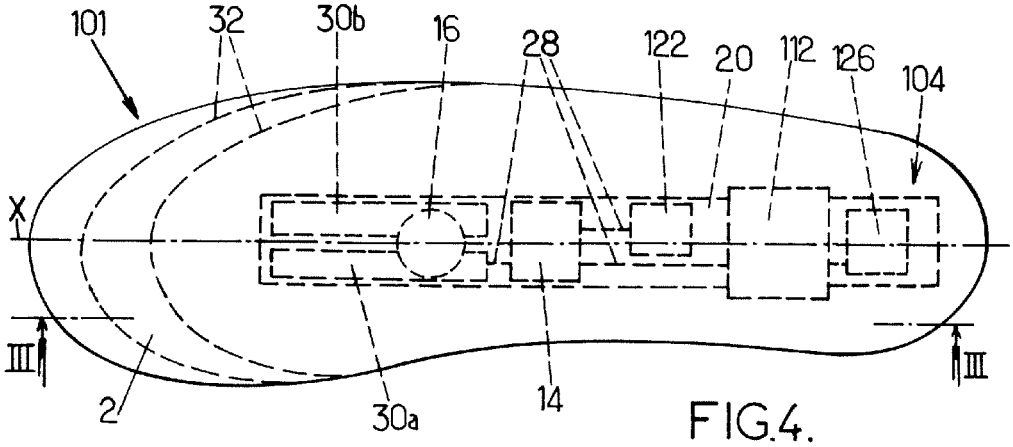
FIG.4.

INSOLE HAVING A VIBRATING DEVICE

FIELD OF THE DISCLOSURE

The invention relates to an insole having a vibrating device and intended to be placed removably in a shoe to be in contact with the foot of a user in order to improve his well-being or even his state of health. This user may be either an adult (male or female) or a child, or even a baby.

In the field of shoes, the expression "insole" is understood to be a thin piece of leather located inside the shoe and above the sole in order to improve the appearance of the shoe.

The invention deals with insoles intended to be placed shoes that can be either a slipper, a smart shoe or a specialist shoe (a work shoe, a motorcycle boot, a sports shoe, an athletics shoe, an auto racing shoe, a golf shoe, a horse riding boot or a ski boot).

The insole may be used to stimulate the foot in order to prevent the accumulation of blood in the lower part of the body, in particular when in a hotel or aeroplane, but also to warm up the foot, in particular when the insole is placed in a ski boot or slipper. The insole may also be used for therapeutic purposes, in particular in cardiology.

BACKGROUND OF THE DISCLOSURE

An insole is already known, in particular from document US 2008/005936, said sole comprises a long and thin body and a vibrating device embedded in said body, said vibrating device comprising an electric accumulator, a control system and a vibration generator The term "embedded" should be understood to mean that the vibrating device does not protrude from the body.

Integrating the vibrating device into the insole firstly makes it possible to concentrate the vibrations as close as possible to the foot of the user, thereby improving the sensation felt.

SUMMARY OF THE DISCLOSURE

The invention aims to still improve the insole, in particular to reduce its cost, improve the satisfaction of the user and encourage its development.

According to the invention, the vibrating device comprises a flexible film electrically connecting the electric accumulator to the vibration generator.

The implantation of the vibrating device in the body of the insole is thus made easier thereby, the thickness of the insole can be reduced and the robustness of the insole is improved.

According to another feature of the invention, the flexible film preferably forms a substrate to which the other elements of the vibrating device are fastened and has electrically conductive tracks.

The implantation of the vibrating device in the body is thus again made easier thereby.

According to a complementary feature of the invention, the insole preferably has a direction of elongation and the vibration generator is fastened to two electrically conductive tracks extending in parallel in the direction of elongation.

Thus, the position of the vibration generator on the flexible film can easily be adjusted depending on the size of the insole.

According to another feature of the invention, the body has a cavity in which the vibrating device is located and the flexible film is covered with an adhesive that holds it at the far end of the cavity.

The vibrating device is thus easily held in the cavity of the body.

Alternatively, the vibrating device is preferably entirely incorporated in the body.

The term "incorporated" should be understood to mean that the vibrating device is entirely covered by the body, for example by overmoulding with the material of which the body is made. It is thus held and protected perfectly in the body.

According to another feature of the invention, preferably the vibrating device further comprises a magnetic wave receiver connected to the control system and is designed to transmit to the control system commands transmitted via magnetic waves.

The magnetic waves require no contact and are transmitted through the body; the control system can thus easily receive commands despite being entirely incorporated in the body.

According to another complementary feature, the electric accumulator is preferably able to be recharged by electromagnetic induction.

By way of this solution, the electric accumulator can be easily recharged contactlessly.

According to an alternative feature of the invention, the electric accumulator is preferably of the rechargeable type and is connected to an electrical connector for recharging.

The service life of the vibrating device is thus increased and the size of the accumulator can be reduced.

According to yet another feature of the invention, the control system selectively commands the vibration generator to generate vibrations at least in a first frequency range between 35 and 50 hertz and in a second frequency range between 50 and 65 hertz.

It has been found that vibrations may have therapeutic effects and that the effects differ depending on the frequency. Being able to generate vibrations at different frequencies makes it easier to set the desired effect. In particular, vibrations between 35 and 50 hertz, preferably between 40 and 45 hertz, are particularly effective for treating osteoporosis, while frequencies between 50 and 65 hertz, preferably between 55 and 60 hertz, are particularly effective for treating diabetes.

According to another feature of the invention, the insole preferably has a heel area and a plantar area, and the electric accumulator is thin and flat and located in the heel area and the vibration generator is located in the plantar area.

This distribution enables the vibrations to be transmitted well into the foot and enables a thin insole to be obtained.

Preferably, the vibrating device has a thickness less than 4 millimeters and very preferably less than 2 millimeters.

Thus, the insole can be slid inside a shoe without thereby substantially reducing the volume available for the foot, while ensuring good robustness. Therefore, the insole can be placed in existing models of shoe that has not been designed for receiving an insole with a vibrating device. Therefore the need to manufacture a special complete shoe is avoided, thereby encouraging its development. The insole could, however, be definitively fixed inside a shoe.

According to another feature of the invention, the insole has at least one pre-cut line at the periphery for adaptation to different shoe sizes.

The invention also relates to an assembly comprising, in addition to the insole, a remote control. In accordance with the invention, the vibrating device also comprises a wave receiver connected to the control system and designed to transmit to the control system commands transmitted by the remote control.

Thus, even when it is entirely covered by the foot of the user which is in the shoe, the vibrations can be controlled.

According to another feature of the invention, preferably the wave receiver is further able to transmit information to the remote control.

According to another feature of the invention, preferably the electric accumulator is able to be recharged by electromagnetic induction through the receiver.

BRIEF DESCRIPTION OF THE DRAWINGS

Further features and advantages of the present invention will become apparent from the following detailed description with reference to the appended drawings, in which:

FIG. 3 is a cross-sectional representation along the line III-III in FIG. 4 of an assembly according to the invention, in a second embodiment, and FIG. 4 is a schematic representation from above of the assembly according to the second embodiment.

DETAILED DESCRIPTION

Figure 1:
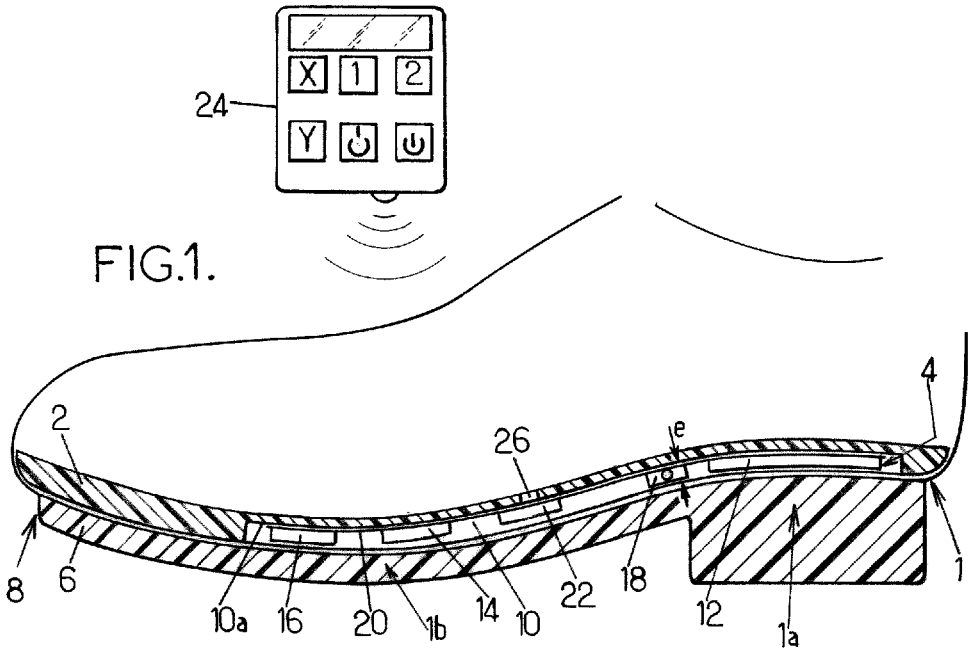
FIG. 1 is a cross-sectional representation along the line I-I in FIG. 2 of an assembly according to the invention, in a first embodiment.
Figure 2:
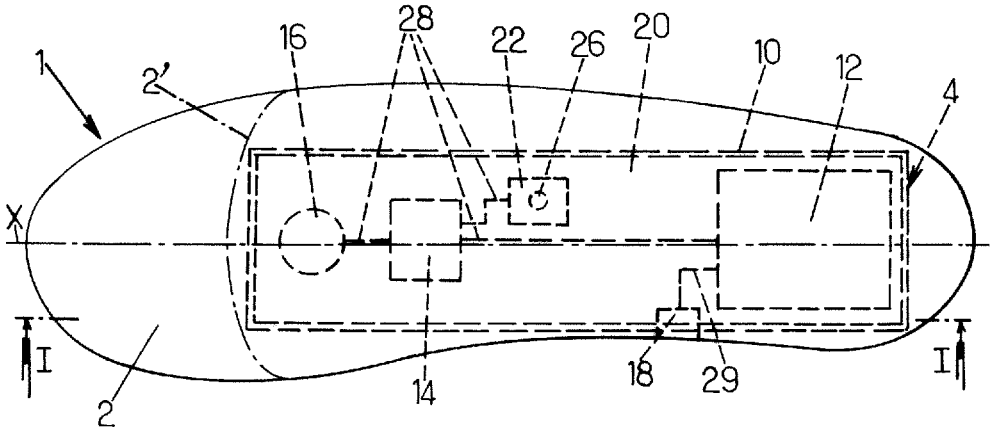
FIG. 2 is a schematic representation from above of the assembly according to the first embodiment.

FIGS. 1 and 2 illustrate an insole 1 located inside a shoe 8 and extending in a direction of elongation X. The insole 1 comprises a vibrating device 4 that can be actuated from a distance by a remote control 24.

The shoe 8 has a sole (outsole) 6 intended to come into contact with the ground and supporting the insole 1 with which the foot of a user is intended to come into contact. The insole 1 is inserted tightly into the internal volume of the shoe intended to hold the user's foot. For reasons of clarity, the thickness of the insole has been increased in FIG. 2.

The insole 1 has a long, thin body 2 of substantially constant thickness. This body 2 is substantially flat with a slight curvature in order to mould to the arch of the user's foot. The body 2 has a cavity 10 opening towards the sole 6 and having a far end 10*a* on which the vibrating device 4 is fastened.

The vibrating device 4 comprises essentially a film 20 forming a flexible, semi-rigid substrate on which an electric accumulator 12, a control system 14, a vibration generator 16, an electrical connector 18 and a wave transceiver 22 are held. Electrically conductive tracks 28 connect the electric accumulator 12, the vibration generator 16 and the wave transceiver 22 to the control system 14. Another electrically conductive track 29 connects the electrical connector 18 to the electric accumulator 12. This latter track could alternatively pass via the control system 14. These electrically conductive tracks are deposited on the film 20.

The electric accumulator 12 consists of a rechargeable battery block which is recharged by inserting an electric plug into the electrical connector 18. The electric accumulator 12 has a substantially square cross section and a thickness less than two millimeters, preferably around a few tenths of a millimeter. It preferably has a cross section of less than 10 square centimeters. It advantageously consists of lithium-polymer, lithium-ion or nickel-cadmium and is preferably protected by a thermistor.

The wave transceiver 22 receives the waves transmitted by the remote control 24 by infrared, radiofrequency, wifi, Bluetooth or the like. A passage 26 is advantageously made through the body 2 to enhance the transmission of waves between the wave transceiver 22 and the remote control 24. The wave transceiver is also able to transmit to the remote control 24 information, such as the state of charge of the electric accumulator 12, working times, pressure of the foot on separate areas of the insole 1 (sensed by the vibration generator 16 or separate sensors) and the like. The information may be displayed on the remote control 24 or transmitted to a computer connected to the remote control 24, for example by a USB port, wifi waves or the like.

The vibration generator 16 is able to generate alternatively at least two vibration frequencies. In order to reduce its thickness, it is preferably of the planar type, having electromagnets or piezoelectric, but could also be of the coil type or consist of a counterweight motor, eccentric motor, or the like.

The control system 14 starts or stops the vibration generator 16. Preferably, it also varies the intensity of the vibrations of the vibration generator 16 and their frequency. It may optionally comprise a processor.

Preferably, depending on the signals received from the remote control 24, the control system 14 is able to command the vibration generator 16, selectively or optionally simultaneously, to generate vibrations in a first frequency range between 35 and 50 hertz and in a second frequency range between 50 and 65 hertz.

The flexible substrate 20 is preferably made of polyethylene terephthalate (PET) or polyimide (PI). It is covered with an adhesive fastening it to the far end 10*a* of the cavity 10.

The body 2 preferably consists of a mixture of cork and a binder, polyamide 6.6 (Teflon®), acrylonitrile butadiene styrene (ABS), polyvinyl chloride (PVC) or a combination of a plastic with natural rubber. It preferably consists of an expanded material or a foam type material. In addition, it is preferably covered with a thin layer made of a non-expanded material, preferably polyvinyl chloride (PVC), and intended to come into contact with the foot of the user.

The insole 1 has a heel area 1*a* for receiving the user's heel and a plantar area 1*b* for receiving the sole of the user's foot. The electric accumulator 12 is located in the heel area 1*a* while the vibration generator 16 is located in the plantar area 1*b* and the other elements of the vibrating device 4 are located between the two.

It should be noted that the vibrating device 4 is embedded (sunk) in the cavity 10, in other words it does not protrude therefrom. It has a thickness e less than 5 millimeters, advantageously less than 3 millimeters and preferably less than 1 millimeter.

The insole 1 may overlie the entire sole 6 or may stop at the front end of the sole 6 as indicated by the dot-dash line 2'.

The insole 101 illustrated in FIGS. 3 and 4 constitutes a variant of the insole 1 illustrated in FIGS. 1 and 2. Identical elements have identical reference numerals. Elements of the insole 101 which are different but correspond to the elements of the insole 1 have reference numerals increased by 100.

The insole 101 differs essentially from the insole 1 in that the vibrating device 104 is not sunk in a cavity in the body but is entirely incorporated in the body 2 such that no element of the vibrating device 104 can be seen from the outside.

The insole 101 may in particular be made by disposing the vibrating device 104 in a mould and encasing it in the material of the body 2.

In addition, since the vibrating device 104 is entirely incorporated in the body 2, the insole 101 is of the contactless type.

Thus, the electric accumulator 112 is rechargeable by induction, by means of an electromagnetic wave generator 118 located at a slight distance from the electric accumulator 112. In order to recharge the electric accumulator 112, the electromagnetic wave generator 118 may advantageously be located in the shoe 8, as illustrated, or alternatively under the shoe 8, the electromagnetic wave generator 118 then preferably being in the form of a mat 218 on which the shoe is placed. The wave transceiver is preferably also able to receive electromagnetic waves transmitted by the electromagnetic generator 118, 218 and transmit the energy generated by said electromagnetic waves to the electric accumulator 112 to charge it.

Moreover, the wave transceiver 122 comprises a magnetic field receiver and the assembly comprises, instead of the remote control 24, a remote control device 124 having a magnetic field generator, preferably a permanent magnet. The various ranges of frequencies and/or the intensity of the vibration generator 16 are controlled by the control system as a function of the signals received by the wave transceiver 122. They may, for example, be selected successively as a function of the number of passages of the remote control device 124 opposite the wave transceiver 122. Furthermore, the vibration generator 16 may be stopped by keeping the remote control device 124 opposite the wave transceiver 122 for a relatively long time (beyond a time limit).

Furthermore, the vibration generator 16 is fastened to two electrically conductive tracks 30*a*, 30*b* forming strips extending parallel to and at a distance from one another in the direction of elongation X.

Moreover, the periphery of the body 2 has, at the front end in the direction of elongation, pre-cut lines 32 for detaching part of the body 2 in order to modify the size of the insole 101.

The vibrating device 104 also comprises an optional recharging device 126. The recharging device 126 converts the mechanical (kinetic) energy of the foot pressing against the insole 101 and/or the thermal energy of the foot into electrical energy. Preferably, in order to convert the kinetic energy into electrical energy, the recharging device 126 comprises a piezoelectric material and in order to convert the thermal energy into electrical energy, the recharging device operates by the inverse Peltier effect. The recharging device 126 may prove sufficient for recharging the accumulator 112 such that it is then not necessary to recharge it by means of the electromagnetic wave generator 118.

It should be noted that the various modifications of the insole 101 illustrated in FIGS. 3 and 4 with respect to the insole 1 illustrated in FIGS. 1 and 2 could be applied independently of one another to the insole 1.

The invention claimed is:

1. Insole intended to be placed removably in a shoe, said insole comprising a long and thin body and a vibrating device embedded in said body, said vibrating device comprising an electric accumulator, a control system and a vibration generator, wherein the vibrating device comprises a flexible film electrically connecting the electric accumulator to the vibration generator.

2. Insole according to claim 1, wherein the flexible film forms a substrate to which the other elements of the vibrating device are fastened and has electrically conductive tracks.

3. Insole according to claim 2, which has a direction of elongation and wherein the vibration generator is fastened to two electrically conductive tracks extending in parallel in the direction of elongation.

4. Insole according to a claim 1, wherein the body has a cavity in which the vibrating device is located and the flexible film is covered with an adhesive that holds it at the far end of the cavity.

5. Insole according to claim 1, wherein the vibrating device is incorporated in said body.

6. Insole according to claim 1, wherein the vibrating device further comprises a wave receiver connected to the control system and is designed to transmit to the control system commands transmitted via magnetic waves.

7. Insole according to claim 1, wherein the electric accumulator is able to be recharged by electromagnetic induction.

8. Insole according to claim 1, wherein the electric accumulator is of the rechargeable type and is connected to an electrical connector for recharging.

9. Insole according to claim 1, wherein the control system selectively commands the vibration generator to generate vibrations at least in a first frequency range between 35 and 50 hertz and in a second frequency range between 50 and 65 hertz.

10. Insole according to claim 1, having a heel area and a plantar area, wherein the electric accumulator is thin and flat and located in the heel area and the vibration generator is located in the plantar area.

11. Insole according to claim 1, wherein the vibrating device has a thickness less than 4 millimeters.

12. Insole according to claim 1, having at least one pre-cut line at the periphery for adaptation to different shoe sizes.

13. Assembly comprising an insole and a remote control, said insole being intended to be placed removably in a shoe and comprising a long and thin body and a vibrating device embedded in said body, said vibrating device comprising an electric accumulator, a control system and a vibration generator, wherein the vibrating device comprises:

a flexible film electrically connecting the electric accumulator to the vibration generator, and a wave receiver connected to the control system and designed to transmit to the control system commands transmitted by the remote control.

14. Assembly according to claim 13 wherein the wave receiver is further able to transmit information to the remote control.

15. Assembly according to claim 13 wherein the electric accumulator is able to be recharged by electromagnetic induction through the receiver.

* * * * *